US008000631B2

(12) United States Patent
Shimizu et al.

(10) Patent No.: US 8,000,631 B2
(45) Date of Patent: Aug. 16, 2011

(54) DEVELOPING DEVICE, IMAGE FORMING APPARATUS, AND IMAGE FORMING METHOD

(75) Inventors: Tamotsu Shimizu, Osaka (JP); Minoru Wada, Osaka (JP)

(73) Assignee: Kyocera Mita Corporation (JP)

( * ) Notice: Subject to any disclaimer, the term of this patent is extended or adjusted under 35 U.S.C. 154(b) by 427 days.

(21) Appl. No.: 11/954,119

(22) Filed: Dec. 11, 2007

(65) Prior Publication Data

US 2008/0160437 A1 Jul. 3, 2008

(30) Foreign Application Priority Data

Dec. 28, 2006 (JP) ..... 2006-354498

(51) Int. Cl.
*G03G 13/04* (2006.01)

(52) U.S. Cl. ..... 399/119; 399/279; 430/84; 430/96

(58) Field of Classification Search ..... 399/119, 399/279; 430/84, 96
See application file for complete search history.

(56) References Cited

U.S. PATENT DOCUMENTS 4,668,599 A * 5/1987 Yamazaki et al. ..... 430/84
4,965,154 A * 10/1990 Karakida et al. ..... 430/57.6
5,008,170 A * 4/1991 Karakida et al. ..... 430/65
5,659,858 A * 8/1997 Kunugi ..... 399/252
6,108,509 A * 8/2000 Okada et al. ..... 399/286
7,505,720 B2 * 3/2009 Sugama et al. ..... 399/286
2005/0277045 A1 * 12/2005 Saito et al. ..... 430/109.3
2006/0133851 A1 * 6/2006 Ishii et al. ..... 399/234

FOREIGN PATENT DOCUMENTS

JP 2003-122047 4/2003

* cited by examiner

*Primary Examiner* — Hoa V Le

(74) *Attorney, Agent, or Firm* — Gerald E. Hespos; Michael J. Porco

(57) ABSTRACT

A developing device is provided to suppress image density unevenness by adjusting conditions of toner adhesion to an amorphous silicon photoconductor to a suitable range even when using both an amorphous silicon photoconductor and a nonmagnetic monocomponent toner and practicing development in a non-contact system. The developing device satisfies the relational expression:

$$(f\times1.5/\theta)^2>-1.576\times10^{-2}\times q/m\times(Vpp/Ds^2)+31.9\times10^6$$

where Ds (m) is a distance between the photoconductor and the toner carrier, f (Hz) is a frequency of an AC bias applied to the toner carrier, Vpp (V) is an amplitude of the AC bias, θ (–) is a ratio of a peripheral speed of the toner carrier to a peripheral speed of the amorphous silicon photoconductor, and q/m (C/kg) is a charge quantity per unit mass of the toner.

4 Claims, 3 Drawing Sheets

DEVELOPING DEVICE, IMAGE FORMING APPARATUS, AND IMAGE FORMING METHOD

BACKGROUND OF THE INVENTION

1. Field of the Invention

The present invention relates to a developing device, an image forming apparatus and an image forming method. In particular, the invention relates to a developing device for developing a nonmagnetic monocomponent toner in a non-contact system, an image forming apparatus including the device, and an image forming method using the device.

2. Description of the Related Art

In image forming methods of electrophotography system such as copying machines and printers, electrophotographic photoconductors (photoconductor drums) have been widely used as latent image carriers. A general image forming method using such an electrophotographic photoconductor is practiced as follows.

A surface of an electrophotographic photoconductor is charged to a predetermined potential using charging means, and light from an LED light source is applied to the surface using exposure means. The potential in the exposed area is thereby optically attenuated to form an electrostatic latent image corresponding to an image. Subsequently, by applying a developing bias to the developing device including a toner carrier, a toner is moved onto the electrophotographic photoconductor and the electrostatic latent image is developed therewith to form a toner image on the surface of the electrophotographic photoconductor. Finally, the toner image formed is transferred to an intermediate transfer body or paper by bringing the electrophotographic photoconductor into contact with or close to transfer means.

The above-mentioned electrophotographic photoconductors can be classified roughly into inorganic photoconductors whose photo sensitive layers each are composed of an inorganic material, such as amorphous silicon, and organic photoconductors whose photo sensitive layers each are composed of an organic material.

Among these, inorganic photoconductors, especially amorphous silicon photoconductors, are widely used because they have so high mechanical strength that their photoconductive layer is resistant to wear even in repeated use and therefore they have an advantage that good quality images can be supplied stably.

However, such amorphous silicon photoconductors have higher dielectric constants in their photoconductive layer in comparison to organic photoconductors. Therefore, some problems have been recognized; for example, a toner tends to adhere to the surface of a photoconductive layer firmly and, as a result, image density unevenness easily occurs due to insufficient detachment of a toner during a developing step.

In particular, when developing a nonmagnetic monocomponent toner in a noncontact system, a toner is caused to fly by a developing bias applied between a toner carrier and an electrophotographic photoconductor and thereby the toner is moved from the toner carrier to the electrophotographic photoconductor. In this event, an attempt to inhibit the adhesion of a toner to the surface of a photoconductive layer tends to cause a problem of insufficient flying of the toner and it has been very difficult to find suitable developing conditions.

In order to prevent a toner from adhering firmly to the surface of a photoconductive layer, a method of effecting development by applying an AC bias to a toner carrier has been disclosed in JP 2003-122047A while not being limited particularly to amorphous silicon photoconductors.

More specifically, JP 2003-122047A discloses an image forming method in which the AC bias is limited to a peak-to-peak electric field strength of from $3\times10^6$ to $1\times10^7$ V/m and a frequency of from 100 to 5000 Hz.

Moreover, in JP 2003-122047A, a gap between an electrophotographic photoconductor and a toner carrier is set within the range of from 100 to 500 μm, and a speed ratio of the electrophotographic photoconductor and the toner carrier is specified within the range of from 1.02 to 3.0.

In the image forming method of JP 2003-122047A, however, no consideration is made to the difference of dielectric constant between electrophotographic photoconductors used. Moreover, no clear distinguishment about the type of toner, namely, magnetic or nonmagnetic, monocomponent or dicomponent, is made about the toner to be used. It may be said that the image forming method is a very rough method.

Therefore, it has been difficult to optimize developing conditions when using an amorphous silicon photoconductor as an electrophotographic photoconductor and a nonmagnetic monocomponent toner as a toner, and practicing the development in a non-contact system. In other words, there has been a problem that it becomes difficult to control an adhesion force of a toner to an amorphous silicon photoconductor and it is impossible to inhibit the occurrence of image density unevenness effectively.

SUMMARY OF THE INVENTION

As a result of extensive investigations, the inventors of the present invention have found that conditions of toner adhesion to an amorphous silicon photoconductor can be adjusted within preferable ranges through adjustment of frequency and amplitude of a bias applied to a toner carrier, a distance and a peripheral speed ratio between an amorphous silicon photoconductor and the toner carrier, and a charge quantity per unit mass of a toner so as to satisfy a predetermined relational expression, and they accomplished the present invention.

An object of the present invention is to provide a developing device which can effectively suppress occurrence of image density unevenness by adjusting conditions of toner adhesion to an amorphous silicon photoconductor even when using both an amorphous silicon photoconductor and a nonmagnetic monocomponent toner and practicing development in a non-contact system, an image forming apparatus including the device, and an image forming method using the device.

According to an aspect of the present invention, there is provided, in order to solve the above-mentioned problems, a developing device for visualizing an electrostatic latent image by making a toner carrier for nonmagnetic monocomponent toner closely arrange to an amorphous silicon photoconductor on which the electrostatic latent image has been formed, wherein, assuming that Ds (m) is a distance between the amorphous silicon photoconductor and the toner carrier, f (Hz) is a frequency of an AC bias applied to the toner support, Vpp (V) is an amplitude of the AC bias, θ (−) is a ratio of a peripheral speed of the toner carrier to a peripheral speed of the amorphous silicon photoconductor, and q/m (C/kg) is a charge quantity per unit mass of the toner, Ds is adjusted to a value within the range of from $0.5\times10^{-4}$ to $1\times10^{-4}$ m, f is adjusted to be a value not greater than $10\times10^3$ Hz, and the following relational expression (1) is satisfied:

$$(f\times1.5/\theta)^2>-1.576\times10^{-2}\times q/m\times(Vpp/Ds^2)+31.9\times10^6 \quad (1)$$

That is, adjusting Ds and f within the predetermined ranges, respectively, allows a toner to fly from the toner carrier to the amorphous silicon photoconductor certainly.

Moreover, when Ds, f, Vpp, θ and q/m satisfy the relational expression (1), it is possible to adjust the adhesion force between the amorphous silicon photoconductor and the toner within a suitable range by causing a predetermined amount of toner to fly to the amorphous silicon photoconductor and simultaneously vibrating the toner having flown onto the amorphous silicon photoconductor.

Accordingly, it is possible to inhibit the occurrence of image density unevenness effectively even when using both an amorphous silicon photoconductor and a nonmagnetic monocomponent toner and practicing the development in a non-contact system.

In constituting the developing device of the invention, the peripheral speed of the toner carrier is preferably adjusted to a value within the range of from 90 to 300 mm/sec.

This constitution enables the toner carried on the toner carrier to fly in proper quality to the amorphous silicon photoconductor.

Also, it becomes easy to adjust the vibration frequency of the toner between the toner carrier and the amorphous silicon photoconductor within a more desirable range.

In constituting the developing device of the invention, the peripheral speed of the amorphous silicon photoconductor is preferably adjusted to a value within the range of from 80 to 200 mm/sec.

Such a constitution makes it possible to develop an electrostatic latent image in proper quality by utilizing the toner flying from the toner carrier.

Also, it becomes easy to adjust the vibration frequency of the toner between the toner carrier and the amorphous silicon photoconductor within a more desirable range.

In constituting the developing device of the invention, the charge quantity q/m (C/kg) per unit mass of the nonmagnetic monocomponent toner is preferably adjusted to a value within the range of from $0.5\times10^{-2}$ to $3\times10^{-2}$ C/kg.

By use of such a constitution, the magnitude of a force received by the toner from an electric field can be adjusted within a preferable range during the flying of the toner from the toner carrier to the amorphous silicon photoconductor and vibration of the toner on the amorphous silicon photoconductor.

In constituting the developing device of the invention, the ten-point average roughness of the surface of the toner carrier measured according to JIS B0601 is preferably adjusted to a value within the range of from 3.5 to 5.0 μm.

Such a constitution improves the uniformity of a thin toner layer formed on the toner carrier.

Therefore, it is possible to cause a toner to fly more uniformly from the toner carrier to the amorphous silicon photoconductor.

According to another aspect of the present invention, there is provided an image forming apparatus characterized by including any one of the developing devices mentioned above.

That is, because of inclusion of such a predetermined developing device, it is possible to suppress the occurrence of image density unevenness even when using both an amorphous silicon photoconductor and a nonmagnetic monocomponent toner and practicing development in a non-contact system.

Therefore, the image quality improvement and cost saving can be realized in a color image forming apparatus in which a magnetic toner is difficult to be used in view of coloring of toners.

According to still another aspect of the present invention, there is provided an image forming method using a developing device for visualizing an electrostatic latent image by making a toner carrier for nonmagnetic monocomponent toner closely arrange to an amorphous silicon photoconductor on which the electrostatic latent image has been formed, wherein, assuming that Ds (m) is a distance between the amorphous silicon photoconductor and the toner carrier, f (Hz) is a frequency of an AC bias applied to the toner carrier, Vpp (V) is an amplitude of the AC bias, θ (–) is a ratio of a peripheral speed of the toner carrier to a peripheral speed of the amorphous silicon photoconductor, and q/m (C/kg) is a charge quantity per unit mass of the nonmagnetic monocomponent toner, Ds is adjusted to a value within the range of from $0.5\times10^{-4}$ to $1\times10^{-4}$ m, f is adjusted to be a value not greater than $10\times10^{3}$ Hz, and the following relational expression (1) is satisfied:

$$(f\times1.5/\theta)^2>-1.576\times10^{-2}\times q/m\times(Vpp/Ds^2)+31.9\times10^6 \quad (1).$$

That is, when practicing image formation so that Ds, f, Vpp, θ and q/m satisfy a predetermined relationship, it is possible to suppress the occurrence of image density unevenness even when using both an amorphous silicon photoconductor and a nonmagnetic monocomponent toner and practicing development in a non-contact system.

DETAILED DESCRIPTION OF THE PREFERRED EMBODIMENTS

First Embodiment

A first embodiment is a developing device for visualizing an electrostatic latent image by making a toner carrier for nonmagnetic monocomponent toner closely arrange to an amorphous silicon photoconductor on which the electrostatic latent image has been formed, wherein, assuming that Ds (m) is a distance between the amorphous silicon photoconductor and the toner carrier, f (Hz) is a frequency of an AC bias applied to the toner carrier, Vpp (V) is an amplitude of the AC bias, θ (–) is a ratio of a peripheral speed of the toner carrier to a peripheral speed of the amorphous silicon photoconductor, and q/m (C/kg) is a charge quantity per unit mass of the toner, Ds is adjusted to a value within the range of from $0.5\times10^{-4}$ to $1\times10^{-4}$ m, f is adjusted to be a value not greater than $10\times10^{3}$ Hz, and the following relational expression (1) is satisfied.

Hereafter, the developing device of first embodiment will be described specifically with reference to the image forming apparatus including the developing device of the invention.

1. Image Forming Apparatus (1) Fundamental Constitution

The image forming apparatus is preferably composed of a photoconductor drum, which is mentioned below, charging means, exposure means, developing means, transfer means, and cleaning means (e.g., cleaning blade and roller).

Figure 1:
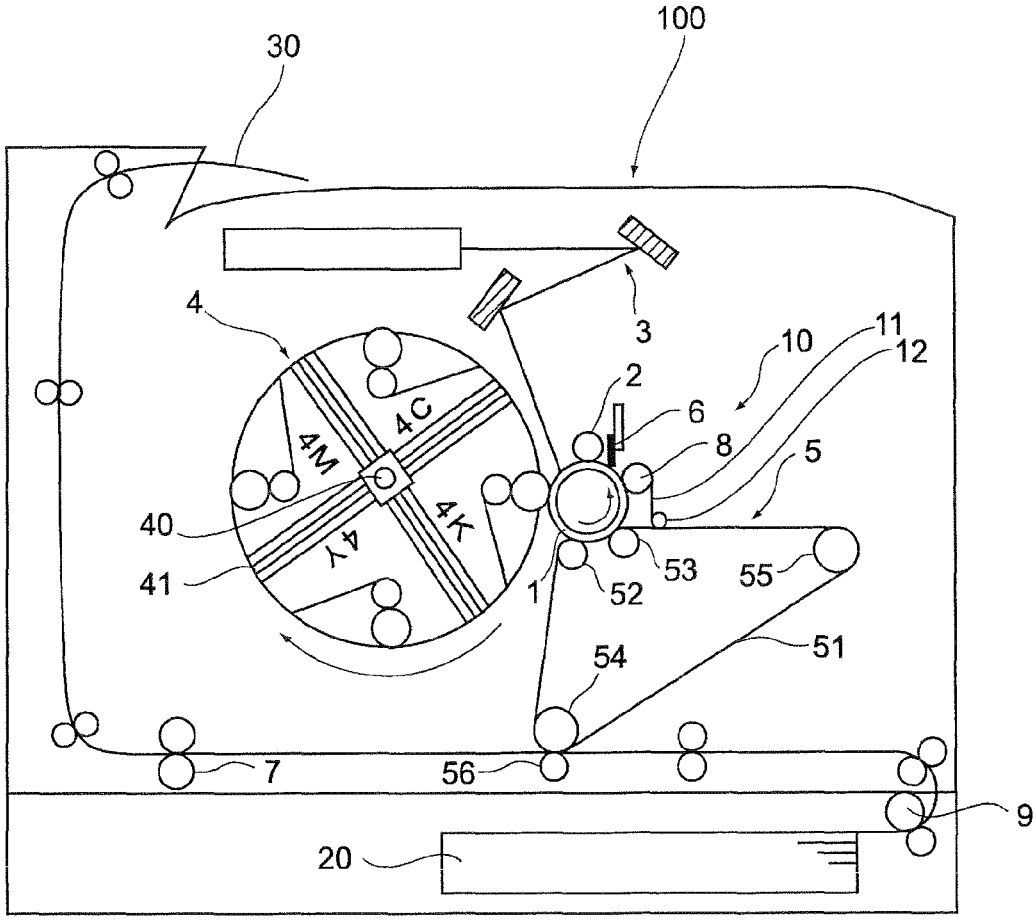
FIG. 1 is a diagram for illustrating the outline of an image forming apparatus of the present invention.

That is, as is shown in FIG. 1, an image forming portion 10 is disposed at an approximate center of a color image forming device 100. It is desirable that the image forming portion 10 has a photoconductor drum 1, and that charging means 2, exposure means 3, developing means 4, transfer means 5, a roller 8, and a cleaning blade 6 are arranged around the photoconductor drum 1 in this order along a direction of the movement of the drum.

Preferably, fixation means 7 is arranged in the downstream of a paper conveying direction of the photoconductor drum 1. Moreover, it is preferable that a paper feeding portion 20 is provided in the lower portion of the image forming apparatus 100 and a paper feeding roller 9 is arranged in the downstream of the paper feeding direction of the paper feeding portion 20.

(2) Photoconductor Drum

The photoconductor drum 1 shown in FIG. 1 is a device on the surface of which an electrostatic latent image is to be formed.

The present invention is characterized in that an amorphous silicon photoconductor is used as the photoconductor drum 1.

This is because an amorphous silicon photoconductor has so high mechanical strength that its photoconductive layer is resistant to wear even in repeated use and therefore the photoconductor has an advantage of being able to stably produce images of good quality.

The photoconductor may be configured such that a carrier injection-blocking layer formed, for example, of Si:H:B:O, a carrier excitation/transport layer (photoconductive layer) formed, for example, of Si:H, and a surface protective layer formed, for example, of SiC:H are sequentially layered.

The peripheral speed of the amorphous silicon photoconductor is preferably adjusted to a value within the range of from 80 to 200 mm/sec.

This is because by adjusting the peripheral speed of the amorphous silicon photoconductor to a value within such a range, it is possible to develop an electrostatic latent image in proper quality by utilizing toner flying from the toner carrier.

That is also because it becomes easy to adjust the vibration frequency of the toner between the toner carrier and the amorphous silicon photoconductor within a desirable range.

In other words, that is also because when the peripheral speed of the amorphous silicon photoconductor becomes a value less than 80 mm/sec, the image forming speed may decrease greatly, leading to decrease in practical utility; or a toner may be supplied excessively to an electrostatic latent image and, as a result, the toner may tend to fly easily to a background area of the electrostatic latent image. That is also because when the peripheral speed of the amorphous silicon photoconductor becomes a value over 200 mm/sec, it may become difficult to develop an electrostatic latent image sufficiently or the vibration frequency of a toner between the toner carrier and the amorphous silicon photoconductor may decrease too much, and as a result, it may become difficult to reduce the adhesion force of the toner to the amorphous silicon photoconductor to a suitable range.

For such reasons, the peripheral speed of the amorphous silicon photoconductor is preferably adjusted to a value within the range of from 100 to 180 mm/sec, and more preferably to a value within the range of from 120 to 160 mm/sec.

(3) Charging Means

The charging means 2 shown in FIG. 1 is disposed above the photoconductor drum 1 so as to charge the photoconductor drum 1 uniformly.

Regarding the kind of such charging means 2, it is preferable to use non-contact charging means, such as a scorotron, and it is more preferable to use a charged roller.

This is because such a charging roller can effectively suppress generation of a discharge product, such as ozone, which is easy to generate in the non-contact charging system.

(4) Exposure Means

The exposure means 3 shown in FIG. 1 is a device for forming an electrostatic latent image on the photoconductor drum 1 on the basis of a document image read from an image data input portion (not shown).

(5) Developing Means

The developing means 4 shown in FIG. 1 is a device for forming a toner image by supplying a toner to the surface of the photoconductor drum 1 on which the an electrostatic latent image has been formed.

The developing means 4 preferably has a rotary rack 41 and a plurality of developing devices 4Y, 4M, 4C, and 4K.

The rotary rack 41 moves the plurality of developing devices 4Y, 4M, 4C and 4K one after another to the developing site facing the photoconductor drum while being rotated about a rotation axis 40 by rotating means (not shown).

Among the plurality of developing devices, the yellow developing device 4Y, the magenta developing device 4M, the cyan developing device 4C, and the black developing device 4K are held in order of 4Y, 4M, 4C and 4K in the circumferential direction of the rotary rack 41, and adjacent developing devices are arranged at intervals of about 90 degrees in the circumferential direction.

The details about the developing device will be given in a later section together with the explanation about the relational expression (1).

The developing means for use in the present invention is not restricted to rotary type developing means and may be tandem type developing means.

(6) Transfer Means

The transfer means 5 shown in FIG. 1 is a device for transferring a toner image on the photoconductor drum 1 to a paper and preferably has an intermediate transfer belt 51, a primary transfer roller 52, a tension roller 53, a driving roller 55, a secondary transfer counter rollers 54, and a secondary transfer roller 56. The primary transfer roller 52 is offset arranged with respect to the photoconductor drum 1. For preventing the occurrence of so-called dropout, a configuration is preferable in which a color toner is transferred to the intermediate transfer belt 51 between the tension roller 53 and the primary transfer roller 52.

The degree of the offset arrangement is required only that a maximum pressurizing point of the primary transfer roller 52 be off a position where a color toner is to be transferred from the photoconductor drum 1 to the intermediate transfer belt 51. It is preferably, for example, a value within the range from 1 to 30 mm, more preferably a value within the range from 2 to 20 mm, and even more preferably a value within the range from 3 to 18 mm.

The intermediate transfer belt 51 is hung endlessly over the primary transfer roller 52, the tension roller 53, the driving roller 55, and the secondary transfer counter roller 54 and is driven by the driving roller 55. The intermediate transfer belt 51 plays a role as a transfer body on which a toner image formed on the photoconductor drum 1 is transferred and temporarily held.

On the other hand, the secondary transfer roller 56 is arranged in the position facing the secondary transfer counter roller 54 on the peripheral surface of the intermediate transfer belt 51, and it plays a role of secondarily transferring a toner image to a transfer material.

(7) Cleaning Blade

The cleaning blade 6 shown in FIG. 1 is a device for cleaning an adhered matter such as a developer remaining on the photoconductor drum 1. A blade made of a rubber having a hardness of from 60 to 80 (e.g., urethane rubber) is preferably in contact with the photoconductor drum at a line pressure of from 10 to 40 N/m.

(8) Roller

A roller 8 has a function as a buffer which collects or discharges a toner while being in contact with the surface of the photoconductor drum 1. The roller 8 has a structure in which the peripheral surface of a metal shaft is covered with a rubber layer having a hardness of from 40 to 70 (e.g., foamed rubber layer). The roller is preferably pressed to the photoconductor drum 1 by springs (not shown) located at the ends of a bearing at a pressure of from 500 to 2000 gf (from 250 to 1000 gf at each spring).

Although the direction of rotation of the roller 8 is a counter direction with respect to the photoconductor drum, a configuration is preferable in which the drive transmission is stopped by a clutch (not shown) when a cleaning operation is not carried out.

Therefore, although the roller 8 is normally rotated in the counter direction in order to cause a toner coming little by little to the cleaning portion to stay near the blade edge, the roller 8 may be rotated in the forward direction when the adsorption and discharge of the toner on the roller 8 are controlled through adjustment of the bias polarity applied to the roller 8.

A drive transmission clutch is provided to prevent the photoconductor drum from being ground too much. However, when the drum has layers thick enough, it is not necessary to stop the driving in order to render the system off.

As to the rotation speed of the roller 8, the surface speed at the contact portion is preferably adjusted to a speed as high as 1 to 1.5 times the speed of the drum. The fixing means 7 is a device for fixing a transferred toner image to a paper.

A scraper 11 is provided for removing off the toner adhering on the roller. A collecting screw 12 is also preferably provided for collecting a toner adhering on the roller or a toner scraped with the blade and fallen on the roller. In such a configuration, a residual toner which has been collected is discharged by the collecting screw 12 to a waste toner box (not shown).

(9) Toner (9)-1 Kind

The toner used in the present invention is characterized by being a nonmagnetic monocomponent toner.

One reason is that because a nonmagnetic toner eliminates the necessity of incorporating a magnetic powder to a toner, it can effectively prevent the color of a pigment from being affected even when the pigment is added to the toner for use as a color toner. Another reason is that the reduction in the weight and cost of an apparatus becomes possible because of no use of a magnet as a toner carrier.

Still another reason is that a monocomponent toner, which includes no carrier, does not have degradation of the toner due to adhesion of toner particles to a carrier surface, and also the toner, which eliminate the necessity of uniformly mixing toner particles and a carrier, can prevent the increase in size of a developing device.

(9)-2 Charge Quantity

The charge quantity q/m per unit mass of the nonmagnetic monocomponent toner is preferably adjusted to a value within the range of from $0.5\times10^{-2}$ to $3\times10^{-2}$ C/kg (5 to 30 μC/g).

This is because adjustment of the charge quantity of a toner within such a range allows the magnitude of a force received by the toner from an electric field to be adjusted within a suitable range during the flying of the toner from the toner carrier to the amorphous silicon photoconductor and the vibration of the toner on the amorphous silicon photoconductor.

In other words, that is because when the charge quantity of a toner becomes a value less than $0.5\times10^{-2}$ C/kg, the charge quantity of a toner becomes so small that the toner will fly with bias or the toner may become difficult to vibrate on the amorphous silicon photoconductor, while on the other hand, when the charge quantity of a toner becomes a value over $3\times10^{-2}$ C/kg, problems may tend to occur, for example, the charge quantity of the toner becomes so great that the toner will adhere firmly to the amorphous silicon photoconductor or the toner particles repel too much each other.

The charge quantity q/m (C/kg) per unit mass of the nonmagnetic monocomponent toner is more preferably adjusted to a value within the range of from $0.7\times10^{-2}$ to $2.7\times10^{-2}$ C/kg (7 to 27 μC/g), and even more preferably to a value within the range of from $1\times10^{-2}$ to $2.5\times10^{-2}$ C/kg (10 to 25 μC/g).

A method of measuring the charge quantity will be described in detail in Examples shown below.

(9)-3 Average Particle Diameter

An average particle diameter of the toner particles is desirably adjusted to a value within the range of from 5 to 20 μm.

This is because when the average particle diameter of the toner particles is a value less than 5 μm, it may become difficult to produce the toner particles stably or the cleaning efficiency of a residual toner may lower, while on the other hand, when the average particle diameter of the toner particles is a value greater than 20 μm, the fluidity of the toner decreases and it may become difficult to form a uniform thin layer of the toner on the toner carrier.

For such reasons, the average particle diameter of the toner particles is more preferably adjusted to a value within the range of from 6 to 15 μm, and even more preferably to a value within the range of from 7 to 12 μm.

The average particle diameter of the toner particles can be measured using, for example, a Coulter multisizer 3 available from Beckman Coulter, Inc.

(9)-4 Average Degree of Circularity

An average degree of circularity of toner particles is desirably adjusted to a value within the range of from 0.9 to 0.99.

One reason is that adjustment of the average degree of circularity of toner particles to a value within such a range makes it possible to more effectively control the adhesion force of the toner particles to the amorphous silicon photoconductor.

In other words, that is because when the average degree of circularity of toner particles becomes a value less than 0.9, a specific surface area of the toner particles increase too much, and it becomes difficult to control the adhesion force of the toner particles to the amorphous silicon photoconductor, while on the other hand, when the average degree of circularity of toner particles is a value over 0.99, the triboelectric charging property of toner particles may deteriorate.

For such reasons, the average degree of circularity of the toner particle is more preferably adjusted to a value within the range of from 0.92 to 0.97, and even more preferably to a value within the range of from 0.93 to 0.96.

The average degree of circularity in the present invention is an arithmetic mean of the value defined by the following formula (2).

The average degree of circularity of toner particles can be measured by dispersing the toner particles in ion exchange water or the like to prepare a dispersion liquid for measurement and then conducting the measurement using, for example, a flow type particle image analyzer, such as FPIA-1000 manufactured by Sysmex Corp.

$$\text{Circularity}=(\text{Circumference of circle having area equal to projected area of particle})/(\text{Perimeter of projected image}) \quad (2)$$

(9)-5 Production Method

Suspension polymerization is desirably used as a method for producing toner particles.

This is because a toner for electrophotography produced by suspension polymerization has a narrow particle size distribution and it is possible to obtain uniform toner particles stably.

It is also because a particle size can be reduced through change of suspension conditions and therefore it is possible to obtain toner particles having excellent charging properties.

Here, the outline of suspension polymerization will be described.

For example, a dispersion liquid is obtained by dispersing a polymerization initiator, a pigment, a mold release agent, a charge control agent, etc. in a radical polymerizable monomer, such as acrylic acid, methacrylic acid, styrene sulfonic acid, and dimethylaminoethyl acrylate. Subsequently, the resulting dispersion liquid is added to water to disperse droplets having a predetermined diameter, followed by polymerization by heating. Finally, the resulting particles are filtered and dried to obtain toner particles.

Other production methods, such as grinding, may also be used.

It is also desirable to add additives to the toner particles.

The reason for this is that addition of additives allows easy adjustment of properties, such as fluidity, adhesive property and charging property, of a toner.

Examples of such additives include inorganic fine particles, such as titanium oxide particles and silica particles.

An average particle diameter of such inorganic fine particles is preferably adjusted to a value within the range of from 2 to 100 nm, and more preferably to a value within the range of from 5 to 80 nm.

Such additives may be mixed with toner particles using a conventional mixing apparatus, such as a Trubula mixer, a Henschel mixer, a Nauta mixer, and a V-type mixer.

2. Developing Conditions (1) Outline of Developing Device

The developing device of the invention is characterized by being a noncontact-type developing device with which a toner is caused to fly from a toner carrier to an amorphous silicon photoconductor.

One reason is that it is essential in the present invention to use a nonmagnetic monocomponent toner as the toner as disclosed in the description about the toner.

Another reason is that such a noncontact-type developing device has advantages that, for example, it can effectively inhibit the staining of a background area in an image formed and can be applied to high-speed development easily.

The fundamental constitution of the developing device of the invention will be described with reference to FIG. 2.

Figure 2A:
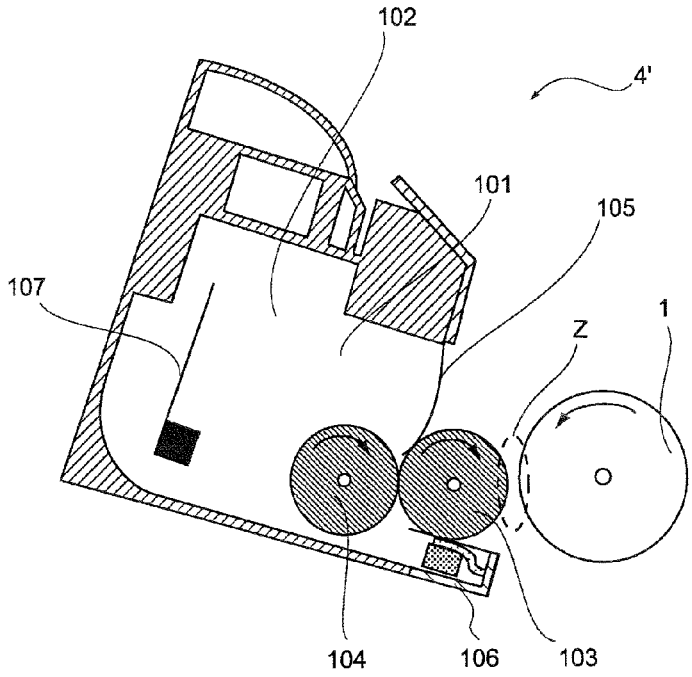
FIGS. 2A and 2B are diagrams for illustrating the outline of a developing device of the present invention.

A developing device 4' shown in FIG. 2A is one of four developing devices (4Y, 4M, 4C, and 4K) included in the developing means 4 in FIG. 1 described above.

As shown in FIG. 2A, a toner agitating portion 102 is filled with a toner. When a toner agitating member 107 is rotated, the toner in the toner agitating portion 102 is agitated uniformly.

A toner feed roller 104 is arranged in the toner agitating portion 102 and a toner is fed to a toner carrier 103 by the toner feed roller 104. At this time, the toner feed roller 104 and the toner carrier 103 are rotating in the same direction so that they move in opposite directions at their contacting portion as indicated by arrows in the drawing. Between the toner feed roller 104 and the toner carrier 103, a voltage is applied in a polarity such that the toner moves from the toner feed roller 104 to the toner carrier 103. The toner which has moved to the toner carrier 103 passes a restricting blade 105 and is sent into a developing region Z.

Subsequently, in the developing region Z, the toner carrier 103 and the amorphous silicon photoconductor 1 are rotating in opposite directions so that they move in the same direction in the developing zone Z at indicated by arrows in the drawing. The developing device is characterized in that development is carried out such that an AC+DC bias is applied to the toner carrier 103 to cause the toner to fly from the toner carrier 103 to the amorphous silicon photoconductor 1.

The toner which was not used in the developing region Z and remains on the toner carrier 104 passes a sealing member 106. The toner is then scraped with the toner feed roller 104 and will be used again.

Figure 2B:
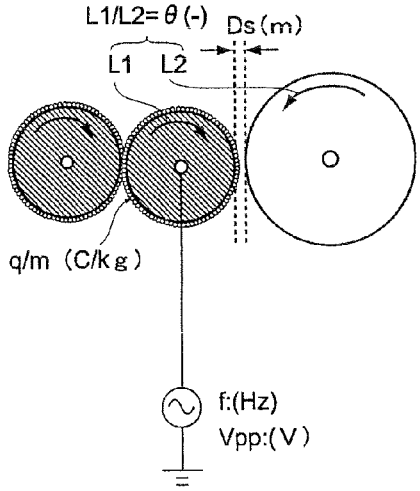

Variables Ds, f, Vpp, θ and q/m in the relational expression (1) of the present invention in the developing device are schematically shown in FIG. 2B.

The developing device is also characterized in that a distance Ds (m) between the amorphous silicon photoconductor 1 in the developing region Z and the toner carrier 103 is adjusted to a value within the range of from $0.5\times10^{-4}$ to $1\times10^{-4}$ m (from 50 to 100 μm) and a frequency f (Hz) of the AC bias applied to the toner carrier 103 is adjusted to a value up to $10\times10^{3}$ Hz (10 kHz).

The reason for this is that adjusting Ds and f to values within the predetermined ranges, respectively, allows a toner to fly from the toner carrier 103 to the amorphous silicon photoconductor 1 certainly.

In other words, that is because when the frequency f becomes a value over $10\times10^{3}$ Hz, the flying distance of a toner decreases proportionately, and as a result, the image density may decrease.

It is necessary to adjust the frequency f within the predetermined range and also adjust the distance Ds between the amorphous silicon photoconductor and the toner carrier within the predetermined range.

In other words, that is also because when the distance Ds becomes a value less than $0.5\times10^{-4}$ m, the distance Ds becomes so small that leakage of a developing bias may occur or a toner may tend to fly to a background area of an electrostatic latent image, while on the other hand, when Ds becomes a value over $1\times10^{-4}$ m, it may, in association with the frequency f, become difficult to cause a toner to fly from the toner carrier to the amorphous silicon photoconductor certainly.

For such reasons, the frequency f (Hz) of the AC bias applied to the toner carrier is more preferably adjusted to a value within the range of from $2\times10^{3}$ to $8\times10^{3}$ Hz (2 to 8 kHz), and even more preferably to a value within the range of from $3.5\times10^{3}$ to $7\times10^{3}$ Hz (3.5 to 7 kHz).

Moreover, the distance Ds (m) between the amorphous silicon photoconductor and the toner carrier is more preferably adjusted to a value within the range of from $0.55\times10^{-4}$ to $0.9\times10^{-4}$ m (55 to 90 μm), and even more preferably to a value within the range of from $0.6\times10^{-4}$ to $0.8\times10^{-4}$ m (60 to 80 μm).

It is also desirable to adjust the amplitude Vpp (V) of the AC bias applied to the toner carrier 103 to a value within the range of from 500 to 1500 V.

This is because when the amplitude Vpp becomes a value less than 500 V, the effect of vibrating a toner on the amorphous silicon photoconductor may become insufficient, while on the other hand, when the amplitude Vpp becomes a value over 1500 V, the developing electric field becomes large and the recovery electric field also becomes large, with the result that, in some cases, a toner having flown to the amorphous silicon photoconductor is collected to the toner carrier too much or leakage tends to occur easily.

For such reasons, the amplitude Vpp (V) of the AC bias applied to the toner carrier is more preferably adjusted to a value within the range of from 600 to 1300 V, and even more preferably to a value within the range of from 700 to 1200 V.

It is also desirable to adjust the DC bias (V) applied to the toner carrier 103 to a value within the range of from 10 to 150 V.

This is because when the DC bias becomes a value less than 10 V, it may become difficult to cause a toner to fly from the toner carrier to the amorphous silicon photoconductor sufficiently, while on the other hand, when the DC bias becomes a value over 150 V, the effect of vibrating a toner on the amorphous silicon photoconductor by the AC bias superimposed may be controlled too much.

For such reasons, the DC bias (V) applied to the toner carrier is more preferably adjusted to a value within the range of from 30 to 130 V, and even more preferably to a value within the range of from 60 to 90 V.

It is desirable to adjust the peak-peak value of the strength of the electric field formed between the amorphous silicon photoconductor 1 and the toner carrier 103 by the DC bias and the AC bias superimposed therewith to a value within the range of from $3\times10^{6}$ to $2.5\times10^{7}$ V/m.

This is because adjusting the peak-peak value (V/m) of the electric field strength to a value within such a range enables improvement in balance between the developing electric field and the recovery electric field, with the result that the adhesion force between the amorphous silicon photoconductor and the toner can be adjusted to a more desirable range.

For such reasons, the peak-peak value of the strength of the electric field formed between the amorphous silicon photoconductor and A the toner carrier is more preferably adjusted to a value within the range of from 5×10 6 to $2.3\times10^{7}$ V/m, and even more preferably to a value within the range of from $9\times10^{6}$ to $2\times10^{7}$ V/m.

The details are omitted because they duplicate the contents of the amplitude Vpp (V) of the AC bias described above.

It is desirable that the peripheral speed of the toner carrier 103 be adjusted to a value within the range of from 90 to 300 mm/sec.

This is because adjusting the peripheral speed of the toner carrier to a value within such a range allows a toner carried on the toner carrier to fly to the amorphous silicon photoconductor in a proper quantity, and also allows easy adjustment of the vibration frequency of the toner between the toner carrier and the amorphous silicon photoconductor.

That is also because when the peripheral speed of the toner carrier becomes a value less than 90 mm/sec, the quantity of a toner supplied to the electrostatic latent image formed on the amorphous silicon photoconductor may decrease too much, while on the other hand, when the peripheral speed of the toner carrier becomes a value over 300 mm/sec, the quantity of the toner supplied to the electrostatic latent image becomes too much and, as a result, a toner may tend to fly easily to a background area of an electrostatic latent image.

For such reasons, the peripheral speed of the toner carrier is more preferably adjusted to a value within the range of from 110 to 270 mm/sec, and even more preferably to a value within the range of from 130 to 250 mm/sec.

Also, it is desirable to adjust the ratio θ (−) of the peripheral speed of the toner carrier 103 to the peripheral speed of the amorphous silicon photoconductor 1 to a value within the range of from 0.5 to 2.

This is because when the peripheral speed ratio θ becomes a value less than 0.5, the relative moving speed of the toner carrier with respect to the amorphous silicon photoconductor becomes too small, which may lead to lack of the toner supplied to the electrostatic latent image formed on the amorphous silicon photoconductor, while on the other hand, when the peripheral speed ratio θ becomes a value over 2, the relative moving speed of the toner carrier with respect to the amorphous silicon photoconductor becomes too large, with the result that, in some cases, the vibration of the toner generated between the amorphous silicon photoconductor and the toner carrier caused by an AC bias is insufficient.

For such reasons, the ratio θ (−) of the peripheral speed of the toner carrier to the peripheral speed of the amorphous silicon photoconductor is more preferably adjusted to a value within the range of from 0.8 to 1.8, and even more preferably to a value within the range of from 0.9 to 1.5.

It is also desirable to adjust the ten-point average roughness of the surface of the toner carrier 103 measured according to JIS B0601 to a value within the range of from 3.5 to 5.0 μm.

This is because by adjusting the ten-point average roughness to a value within such a range, it is possible to make a toner thin layer formed on the toner carrier more uniform.

That is also because when the ten-point average roughness becomes either smaller than 3.5 μm or greater than 5.0 μm, it may become difficult to maintain the toner thin film on the toner carrier more uniformly when change with time or change of environment occurs.

For such reasons, the ten-point average roughness of a developing sleeve measured according to JIS B0601 is more preferably adjusted to a value within the range of from 3.8 to 4.8 μm.

(2) Relational Expression (1)

One characteristic is that the following relational expression (1) is satisfied:

$$(f\times1.5/\theta)^2>-1.576\times10^{-2}\times q/m\times(Vpp/Ds^2)+31.9\times10^{6} \quad (1)$$

where Ds (m) is a distance between the amorphous silicon photoconductor and the toner carrier, f (Hz) is a frequency of an AC bias applied to the toner carrier, Vpp (V) is an amplitude of the AC bias, θ (−) is a ratio of a peripheral speed of the toner carrier to a peripheral speed of the amorphous silicon photoconductor, and q/m (C/kg) is a charge quantity per unit mass of toner.

This is because when Ds, f, Vpp, θ and q/m satisfy the relational expression (1), it is possible to adjust the adhesion force between the amorphous silicon photoconductor and the toner within a suitable range by causing a predetermined amount of toner to fly to the amorphous silicon photoconductor and simultaneously vibrating the toner having flown onto the amorphous silicon photoconductor.

Therefore, that is also because it is possible to control the occurrence of image density unevenness effectively even when using both an amorphous silicon photoconductor and a nonmagnetic monocomponent toner and practicing development in a non-contact system.

Here, existing problems are described specifically. Amorphous silicon photoconductors have higher dielectric constants in their photoconductive layer in comparison to organic photoconductors. Therefore, some problems have been recognized; for example, a toner tends to adhere to the surface of a photoconductive layer firmly and, as a result, image density unevenness easily occurs due to insufficient detachment of a toner during a developing step.

In particular, when developing a nonmagnetic monocomponent toner in a noncontact system, a toner is caused to fly by a developing bias applied between a toner carrier and an electrophotographic photoconductor and thereby the toner is moved from the toner carrier to the electrophotographic photoconductor. Therefore, an attempt to inhibit the adhesion of a toner to the surface of a photoconductive layer tends to cause a problem of insufficient flying of toner and it has been very difficult to find suitable developing conditions.

In light of such a situation, the present inventors have derived, through the process shown below, a relational expression (1) as developing conditions which can solve such problems.

It is known that the developing property is closely related to the moving distance of a toner in a developing region. More specifically, when the moving distance of a toner is long enough in comparison to Ds mentioned above, the image density is improved and it is possible to inhibit the occurrence of image density unevenness effectively.

Accordingly, as shown below, the attention was first paid to the equation of motion of a toner.

$$\text{Moving distance of toner} \propto 0.5 \times at^2 \qquad \text{Equation of motion}$$

(a: acceleration, t: time)

$\propto qE/m \times t^2$ (q: charge of toner, m: mass of toner, E: developing electric field)

$\propto q/m \times V/Ds \times (\frac{1}{2}f)^2$ (V: Developing bias)

Assuming that the moving distance of a toner is "n×Ds" (n is a positive constant), the following is obtained:

$$n \times Ds \propto q/m \times V/Ds \times (\tfrac{1}{2}f)^2$$

$$(2f)^2 \propto q/m \times V/(Ds \times n \times Ds)$$

$$f^2 \propto 1/n \times \{(q/m) \times (V/Ds)\}/Ds$$

In the formulae, the left side is a square of the frequency at an AC bias, and thus this indicates the vibration frequency of the toner. That is, the greater the left side, the more the vibration frequency of a toner. The right side is proportional to "developing electric field/Ds", and thus it indicates the moving property of a toner, namely, how easy the toner can move between a toner carrier and an amorphous silicon photoconductor. That is, the greater the right side becomes, the better the mobility of the toner becomes.

In an actual situation, on the other hand, the amorphous silicon photoconductor and the toner carrier are rotating, respectively. Therefore, the vibration frequency of a toner is influenced by θ, namely, the ratio of the peripheral speed of the toner carrier to the peripheral speed of the amorphous silicon photoconductor.

In considering the difference of the vibration frequency of a toner between a case at θ=1.05 and a standard case at θ=1.5, the ratio 1.5/1.05 is 1.43 (times), namely, the vibration frequency at θ=1.05 is as great as 1.43 times the vibration frequency at standard θ=1.5.

The above description about θ is mainly directed to a situation where the peripheral speed of an amorphous silicon photoconductor is made constant and the peripheral speed of a toner carrier is varied.

Then, when the effect of θ is taken into account in the left side of the above formula showing the vibration frequency of a toner, a relational expression $(f \times 1.5/\theta)^2 \propto 1/n \times \{(q/m) \times (V/Ds)\}/Ds$ is derived.

Finally, when actual developing conditions are substituted into the relational expression and the correlation with the generation of image density unevenness under the conditions is examined, the relational expression (1) can be obtained.

The reason why the developing bias V is adjusted to the amplitude Vpp of the AC bias in the step of producing the relational expression (1) is that the AC bias is a factor which controls the flying of a toner while the DC bias is a factor which controls the adhesion quantity of a toner to the photoconductor.

It is desirable to adjust the value of the left side $(f \times 1.5/\theta)^2$ in the relational expression (1) to a value of $95 \times 10^6$ (1/sec$^2$) or less.

This is because when the value of the left side in the relational expression (1) becomes a value over $95 \times 10^6$ (1/sec$^2$), the image density may become insufficient due to too much increase of the vibration frequency of a toner, while on the other hand, when the value of the left side in the relational expression (1) becomes too small, the vibration frequency of a toner is shortened and, as a result, it may become difficult to reduce the adhesion force of a toner to the amorphous silicon photoconductor sufficiently.

For such reasons, the value of the left side $(f \times 1.5/\theta)^2$ in the relational expression (1) is more preferably adjusted to a value within the range of from $3 \times 10^6$ to $95 \times 10^6$ (1/sec$^2$), and even more preferably to a value within the range of from $5 \times 10^6$ to $85 \times 10^6$ (1/sec$^2$).

It is desirable to adjust the value of the variable part of the right side $(q/m \times (Vpp/Ds^2))$ in the relational expression (1) to a value of $7000 \times 10^6$ (1/sec$^2$) or less.

This is because when the value of the variable part of the right side in the relational expression (1) becomes a value over $7000 \times 10^6$ (1/sec$^2$), the moving performance of a toner increases excessively, with the result that leakage between the amorphous silicon photoconductor and the toner carrier may tend to occur, while on the other hand, when the value of the variable part of the right side in the relational expression (1) becomes too a small value, the mobility of a toner decreases excessively, which may lead to difficulty in causing a sufficient amount of toner to fly from the toner carrier to the amorphous silicon photoconductor.

For such reasons, the value of the variable part of the right side $(q/m \times (Vpp/Ds^2))$ in the relational expression (1) is more preferably adjusted to a value within the range of from $1000 \times 10^6$ to $6500 \times 10^6$ (1/sec$^2$), and even more preferably to a value within the range of from $2000 \times 10^6$ to $6000 \times 10^6$ (1/sec$^2$).

Next, a relationship between the relational expression (1) and the occurrence of image density unevenness will be explained with reference to FIG. 3.

Figure 3:
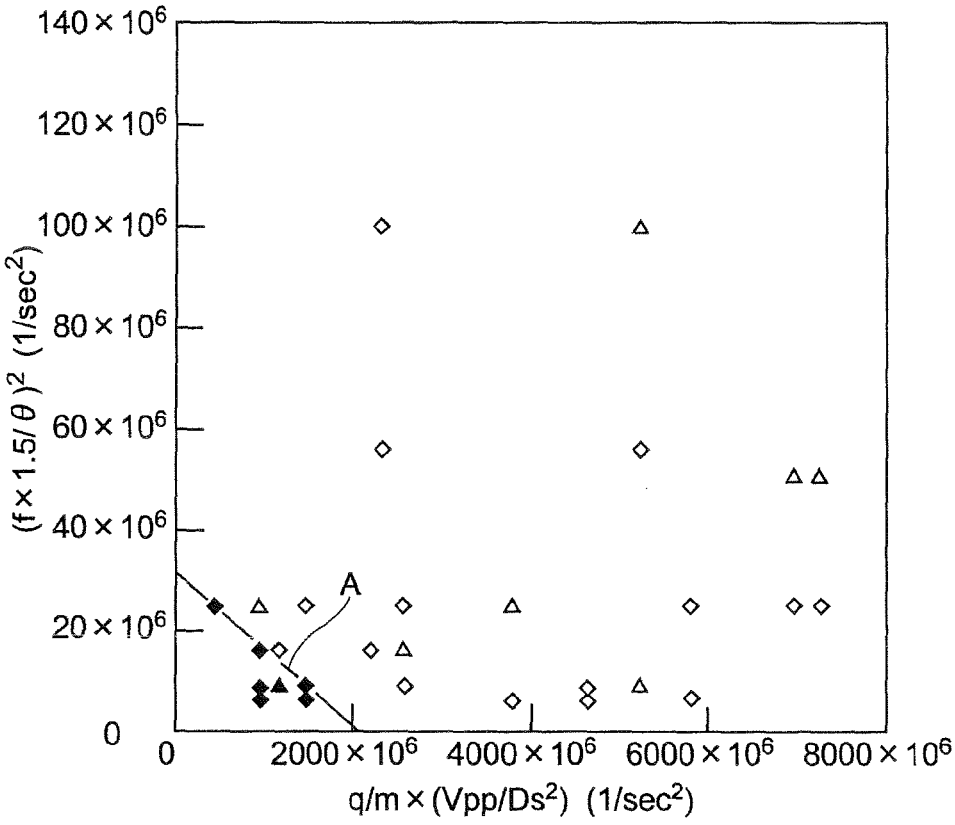
FIG. 3 is a graph for illustrating a relationship between the relational expression (1) and the occurrence of image density unevenness.

FIG. 3 shows a scatter diagram plotting the value of the variable part of the right side $(q/m \times (Vpp/Ds^2))$ (1/sec$^2$) in the relational expression (1) on the abscissa, and the left side $((f \times 1.5/\theta)^2)$ (1/sec$^2$) in the relational expression (1) on the ordinate.

Although the position of the plot in the scatter diagram is determined in accordance with each developing condition, the distance Ds between the amorphous silicon photoconductor and the toner carrier is adjusted to a value within the range of from $0.5 \times 10^{-4}$ to $1 \times 10^{-4}$ μm and the frequency f of the AC bias applied to the toner carrier is adjusted to a value of $10\times10^3$ Hz or less for all developing conditions.

The difference in the marker in each plot is determined on the basis of whether image density unevenness in a formed image occurred or not and a difference in the value of θ as shown below.

◇: No occurrence of image density unevenness was recognized. (θ=1.5)

◆: Some occurrence of image density unevenness was recognized. (θ=1.5)

Δ: No occurrence of image density unevenness was recognized. (θ=1.05)

▲: Some occurrence of image density unevenness was recognized. (θ=1.05)

It is noted that straight line A in the scatter diagram is based on the following relational expression (3).

$$(f\times1.5/\theta)^2=-1.576\times10^{-2}\times q/m\times(Vpp/Ds^2)+31.9\times10^6 \quad (3).$$

As may be understood from the scatter diagram, the occurrence of image density unevenness can be inhibited effectively in the region above straight line A, while it is difficult to inhibit the occurrence of image density unevenness in the region below straight line A.

It therefore is understood that when developing conditions satisfy the relational expression (1), it is possible to inhibit the occurrence of image density unevenness effectively.

Second Embodiment

A second embodiment is an image forming method using a developing device for visualizing an electrostatic latent image by making a toner carrier for nonmagnetic monocomponent toner closely arrange to an amorphous silicon photoconductor on which the electrostatic latent image has been formed, wherein assuming that Ds (m) is a distance between the amorphous silicon photoconductor and the toner carrier, f (Hz) is a frequency of an AC bias applied to the toner carrier, Vpp (V) is an amplitude of the AC bias, θ (–) is a ratio of a peripheral speed of the toner carrier to a peripheral speed of the amorphous silicon photoconductor, and q/m (C/kg) is a charge quantity per unit mass of the nonmagnetic monocomponent toner, Ds is adjusted to a value within the range of from $0.5\times10^{-4}$ to $1\times10^{-4}$ m, f is adjusted to be a value not greater than $10\times10^3$ Hz, and the relational expression (1) is satisfied.

Hereafter, contents different from those of the first embodiment are mainly indicated in order to avoid duplication in the description about the first embodiment.

While referring to FIG. 1 with respect to the image forming method using the above-described image forming apparatus, the motions of the apparatus will be described in an orderly manner.

First, a photoconductor drum 1 of an image forming apparatus 100 is rotated in a direction shown by the arrow at a predetermined process speed (peripheral speed) and the surface thereof is charged to a predetermined potential with charging means 2.

Then, light is applied to the photoconductor drum 1 with exposure means 3 through a reflecting mirror or the like under optical modulation depending on image information. Thus, the surface of the photoconductor drum 1 is exposed to the light. This exposure forms an electrostatic latent image on the surface of the photoconductor drum 1.

Subsequently, a latent image is developed using developing means 4 on the basis on the electrostatic latent image. The developing means 4 contains a toner therein, and the toner adheres corresponding to the electrostatic latent image on the surface of the photoconductor drum 1 to thereby form a toner image.

The details about the developing step are omitted because they have been described in the first embodiment.

A recording paper 20 is conveyed along a predetermined transfer conveying route to a nipping position between a secondary transfer roller 56 and an intermediate transfer belt 51. At this time, applying a predetermined transfer bias to the secondary transfer roller 52 allows the toner image to be transferred onto the recording paper 20.

Then, the recording paper 20 after the toner image transfer is conveyed by a fixing unit. Here, the recording paper is subjected to heating and pressurizing with the fixing unit and thereby the toner image is fixed to the surface. Then, the recording paper is discharged with discharge rollers to the outside of the image forming device 100.

On the other hand, the photoconductor drum 1 continues to rotate after the transfer of the toner image. The residual toner (adhered matter) which was not transferred to the recording paper during the transfer process is removed from the surface of the photoconductor 1 with a roller 8 and a cleaning blade 6.

The image forming method of the present invention is characterized by effecting image formation so that Ds, f, Vpp, θ, and q/m satisfy a predetermined relationship.

Therefore, it is possible to inhibit the occurrence of image density unevenness effectively even when using both an amorphous silicon photoconductor and a nonmagnetic monocomponent toner and practicing the development in a noncontact system.

EXAMPLES

Example 1

The image forming apparatus 100, shown in FIG. 1, equipped with the developing device 4' shown in FIG. 2 was used to print an image pattern repeatedly on 1000 sheets under the normal environment (temperature: 20° C., humidity: 65% RH). Then, image density unevenness and the occurrence of leakage were observed visually and evaluated in accordance with the following criteria. The results are shown in Table 1. The developing conditions are shown below.

The valuation criteria of image density unevenness are as follows.

○ (Good): No image density unevenness was recognized.

x (Bad): Some image density unevenness was recognized.

The valuation criteria of occurrence of leakage are as follows.

○ (Good): Occurrence of leakage was not recognized.

Δ (Fair): A small degree of leakage was recognized, but it was permissible.

x (Bad): Clear leakage was recognized.

An image forming apparatus of the same type as described above was used to form images, and the image density was evaluated.

That is, after practicing image formation as well as the evaluations of the image density unevenness and the occurrence of leakage, the solid image density, which was a printed image evaluation pattern, was measured using a Macbeth reflection density meter (manufactured by Macbeth Co.). More specifically, the density was measured at arbitrary nine points in a black solid portion of the solid image pattern and an average value of the measurements was calculated and used as an image density. Subsequently, the image density was evaluated in accordance with the following criteria. The results are shown in Table 1.

○ (Good): The image density is a value of 1.4 or more.

Δ (Fair): The image density is a value not less than 1.2 but less than 1.4.

x (Bad): The image density is a value less than 1.2.

Developing conditions in the image formation mentioned above are as follows.

Printing speed: 6 sheets/min

Peripheral speed of photoconductor: 150 mm/sec

Peripheral speed of toner carrier: 225 m/sec

Peripheral speed of toner feed roller: peripheral speed ratio of 0.7 relative to speed of toner carrier (counter rotation)

Photoconductor potential ($V_0$)=+300 V

Photoconductor light potential ($V_L$)=+20 V

Toner carrier bias (AC component): rectangular wave

Toner feed roller bias: potential equal to restricting blade bias

Toner (suspension polymerized toner): toner having average particle diameter of 8 μm, positively charging property, and circularity of 0.97 or more Toner carrier: silicone rubber, rubber hardness: 57 in Asker A scale Photoconductor: amorphous silicon photoconductor Distance (Ds) between amorphous silicon photoconductor and toner carrier: $1\times10^{-4}$ m (100 μm)

Frequency (f) of AC bias applied to toner carrier: $5\times10^{3}$ Hz (5 kHz)

Amplitude (Vpp) of AC bias applied to toner carrier: 1000 V

DC bias applied to toner carrier: 90 V

Ratio (θ) of peripheral speed of toner carrier to peripheral speed of amorphous silicon photoconductor: 1.5

Charge quantity of toner (q/m): $1.45\times10^{-2}$ C/kg (14.5 μC/g)

As another condition, the toner feed roller used was one composed of a foamed urethane semi-electroconductive material and having a resistance of $3\times10^{8}\Omega$.

The amount of pushing of the toner carrier into the toner feed roller was adjusted to 0.9 mm, and the bias of the toner feed roller was adjusted to +100 V relative to the toner carrier.

The charge quantity of a toner (q/m) was measured using a Q/M meter (Model 210HS-2A) manufactured by TREK, Inc.

The toner on the toner carrier was sucked, and the charge quantity of the toner (q/m) was calculated using the value of charge quantity measured with the Q/M meter and the weight of the toner collected.

Example 2

In Example 2, image formation was performed in the same manner as Example 1 except that, among the developing conditions, the distance (Ds) between the amorphous silicon photoconductor and the toner carrier was changed to $0.75\times10^{-4}$ m (75 μm), and then the image density unevenness, the shortage of image density, and the occurrence of leakage were visually evaluated. The results are shown in Table 1.

Example 3

In Example 3, image formation was performed in the same manner as Example 1 except that, among the developing conditions, the distance (Ds) between the amorphous silicon photoconductor and the toner carrier was changed to $0.5\times10^{-4}$ m (50 μm), and then the image density unevenness, the shortage of image density, and the occurrence of leakage were visually evaluated. The results are shown in Table 1.

Example 4

In Example 4, image formation was performed in the same manner as Example 1 except that, among the developing conditions, the amplitude (Vpp) of the AC bias applied to the toner carrier was changed to 800 V and the frequency (f) of the AC bias applied to the toner carrier was changed to $4\times10^{3}$ Hz (4 kHz), and then the image density unevenness, the shortage of image density, and the occurrence of leakage were visually evaluated. The results are shown in Table 1.

Example 5

In Example 5, image formation was performed in the same manner as Example 1 except that, among the developing conditions, the amplitude (Vpp) of the AC bias applied to the toner carrier was changed to 850 V, the distance (Ds) between the amorphous silicon photoconductor and the toner carrier was changed to $0.75\times10^{-4}$ m (75 μm), and the frequency (f) of the AC bias applied to the toner carrier was changed to $4\times10^{3}$ Hz (4 kHz). Then, the image density unevenness, the shortage of image density, and the occurrence of leakage were visually evaluated. The results are shown in Table 1.

Example 6

In Example 6, image formation was performed in the same manner as Example 1 except that, among the developing conditions, the distance (Ds) between the amorphous silicon photoconductor and the toner carrier was changed to $0.75\times10^{-4}$ m (75 μm) and the frequency (f) of the AC bias applied to the toner carrier was changed to $3\times10^{3}$ Hz (3 kHz). Then, the image density unevenness, the shortage of image density, and the occurrence of leakage were visually evaluated. The results are shown in Table 1.

Example 7

In Example 7, image formation was performed in the same manner as Example 1 except that, among the developing conditions, the amplitude (Vpp) of the AC bias applied to the toner carrier was changed to 800 V, the distance (Ds) between the amorphous silicon photoconductor and the toner carrier was changed to $0.5\times10^{-4}$ m (50 μm), and the frequency (f) of the AC bias applied to the toner carrier was changed to $3\times10^{3}$ Hz (3 kHz). Then, the image density unevenness, the shortage of image density, and the occurrence of leakage were visually evaluated. The results are shown in Table 1.

Example 8

In Example 8, image formation was performed in the same manner as Example 1 except that, among the developing conditions, the distance (Ds) between the amorphous silicon photoconductor and the toner carrier was changed to $0.5\times10^{-4}$ m (50 μm), and the frequency (f) of the AC bias applied to the toner carrier was changed to $2.5\times10^{3}$ Hz (2.5 kHz). Then, the image density unevenness, the shortage of image density, and the occurrence of leakage were visually evaluated. The results are shown in Table 1.

Example 9

In Example 9, image formation was performed in the same manner as Example 1 except that, among the developing conditions, the amplitude (Vpp) of the AC bias applied to the toner carrier was changed to 800 V, the distance (Ds) between the amorphous silicon photoconductor and the toner carrier was changed to $0.5\times10^{-4}$ m (50 μm), and the frequency (f) of the AC bias applied to the toner carrier was changed to $2.5\times10^{3}$ Hz (2.5 kHz). Then, the image density unevenness, the shortage of image density, and the occurrence of leakage were visually evaluated. The results are shown in Table 1.

Example 10

In Example 10, image formation was performed in the same manner as Example 1 except that, among the developing conditions, the amplitude (Vpp) of the AC bias applied to the toner carrier was changed to 650 V, the distance (Ds) between the amorphous silicon photoconductor and the toner carrier was changed to $0.5\times10^{-4}$ m (50 μm), and the frequency (f) of the AC bias applied to the toner carrier was changed to $2.5\times10^{3}$ Hz (2.5 kHz). Then, the image density unevenness, the shortage of image density, and the occurrence of leakage were visually evaluated. The results are shown in Table 1.

Example 11

In Example 11, image formation was performed in the same manner as Example 1 except that, among the developing conditions, the amplitude (Vpp) of the AC bias applied to the toner carrier was changed to 650 V, the ratio (θ) of the peripheral speed of the toner carrier to the peripheral speed of the amorphous silicon photoconductor was changed to 1.05, and the frequency (f) of the AC bias applied to the toner carrier was changed to $3.5\times10^{3}$ Hz (3.5 kHz). Then, the image density unevenness, the shortage of image density, and the occurrence of leakage were visually evaluated. The results are shown in Table 1.

Example 12

In Example 12, image formation was performed in the same manner as Example 1 except that, among the developing conditions, the amplitude (Vpp) of the AC bias applied to the toner carrier was changed to 650 V, the distance (Ds) between the amorphous silicon photoconductor and the toner carrier was changed to 50 μm, the ratio (θ) of the peripheral speed of the toner carrier to the peripheral speed of the amorphous silicon photoconductor was changed to 1.05, and the frequency (f) of the AC bias applied to the toner carrier was changed to $3.5\times10^{3}$ Hz (3.5 kHz). Then, the image density unevenness, the shortage of image density, and the occurrence of leakage were visually evaluated. The results are shown in Table 1.

Example 13

In Example 13, image formation was performed in the same manner as Example 1 except that, among the developing conditions, the distance (Ds) between the amorphous silicon photoconductor and the toner carrier was changed to $0.75\times10^{-4}$ m (75 μm), the ratio (θ) of the peripheral speed of the toner carrier to the peripheral speed of the amorphous silicon photoconductor was changed to 1.05, and the frequency (f) of the AC bias applied to the toner carrier was changed to $2.8\times10^{3}$ Hz (2.8 kHz). Then, the image density unevenness, the shortage of image density, and the occurrence of leakage were visually evaluated. The results are shown in Table 1.

Example 14

In Example 14, image formation was performed in the same manner as Example 1 except that, among the developing conditions, the amplitude (Vpp) of the AC bias applied to the toner carrier was changed to 900 V, the distance (Ds) between the amorphous silicon photoconductor and the toner carrier was changed to $0.5\times10^{-4}$ m (50 μm), the ratio (θ) of the peripheral speed of the toner carrier to the peripheral speed of the amorphous silicon photoconductor was changed to 1.05, and the frequency (f) of the AC bias applied to the toner carrier was changed to $2.1\times10^{3}$ Hz (2.1 kHz). Then, the image density unevenness, the shortage of image density, and the occurrence of leakage were visually evaluated. The results are shown in Table 1.

Example 15

In Example 15, image formation was performed in the same manner as Example 1 except that, among the developing conditions, the amplitude (Vpp) of the AC bias applied to the toner carrier was changed to 1250 V, the distance (Ds) between the amorphous silicon photoconductor and the toner carrier was changed to $0.5\times10^{-4}$ m (50 μm), and the ratio (θ) of the peripheral speed of the toner carrier to the peripheral speed of the amorphous silicon photoconductor was changed to 1.05. Then, the image density unevenness, the shortage of image density, and the occurrence of leakage were visually evaluated. The results are shown in Table 1.

Example 16

In Example 16, image formation was performed in the same manner as Example 1 except that, among the developing conditions, the amplitude (Vpp) of the AC bias applied to the toner carrier was changed to 1250 V and the distance (Ds) between the amorphous silicon photoconductor and the toner carrier was changed to $0.5\times10^{-4}$ m (50 μm), and then the image density unevenness, the shortage of image density, and the occurrence of leakage were visually evaluated. The results are shown in Table 1.

Example 17

In Example 17, image formation was performed in the same manner as Example 1 except that, among the developing conditions, the amplitude (Vpp) of the AC bias applied to the toner carrier was changed to 1200 V, the distance (Ds) between the amorphous silicon photoconductor and the toner carrier was changed to $0.5\times10^{-4}$ m (50 μm), and the ratio (θ) of the peripheral speed of the toner carrier to the peripheral speed of the amorphous silicon photoconductor was changed to 1.05. Then, the image density unevenness, the shortage of image density, and the occurrence of leakage were visually evaluated. The results are shown in Table 1.

Example 18

In Example 18, image formation was performed in the same manner as Example 1 except that, among the developing conditions, the amplitude (Vpp) of the AC bias applied to the toner carrier was changed to 1200 V and the distance (Ds) between the amorphous silicon photoconductor and the toner carrier was changed to $0.5\times10^{-4}$ m (50 μm), and then the image density unevenness, the shortage of image density, and the occurrence of leakage were visually evaluated. The results are shown in Table 1.

Example 19

In Example 19, image formation was performed in the same manner as Example 1 except that, among the developing conditions, the amplitude (Vpp) of the AC bias applied to the toner carrier was changed to 900 V, the distance (Ds) between the amorphous silicon photoconductor and the toner carrier was changed to $0.5\times10^{-4}$ m (50 μm), and the frequency (f) of the AC bias applied to the toner carrier was changed to $7.5\times10^{3}$ Hz (7.5 kHz). Then, the image density unevenness, the shortage of image density, and the occurrence of leakage were visually evaluated. The results are shown in Table 1.

Example 20

In Example 20, image formation was performed in the same manner as Example 1 except that, among the developing conditions, the amplitude (Vpp) of the AC bias applied to the toner carrier was changed to 900 V, the distance (Ds) between the amorphous silicon photoconductor and the toner carrier was changed to $0.75\times10^{-4}$ m (75 μm), and the frequency (f) of the AC bias applied to the toner carrier was changed to $7.5\times10^{3}$ Hz (7.5 kHz). Then, the image density unevenness, the shortage of image density, and the occurrence of leakage were visually evaluated. The results are shown in Table 1.

Example 21

In Example 21, image formation was performed in the same manner as Example 1 except that, among the developing conditions, the amplitude (Vpp) of the AC bias applied to the toner carrier was changed to 900 V, the distance (Ds) between the amorphous silicon photoconductor and the toner carrier was changed to $0.75\times10^{-4}$ m (75 μm), and the frequency (f) of the AC bias applied to the toner carrier was changed to $10\times10^{3}$ Hz (10 kHz). Then, the image density unevenness, the shortage of image density, and the occurrence of leakage were visually evaluated. The results are shown in Table 1.

Example 22

In Example 22, image formation was performed in the same manner as Example 1 except that, among the developing conditions, the amplitude (Vpp) of the AC bias applied to the toner carrier was changed to 900 V, the distance (Ds) between the amorphous silicon photoconductor and the toner carrier was changed to $0.5\times10^{-4}$ m (50 μm), and the frequency (f) of the AC bias applied to the toner carrier was changed to $10\times10^{3}$ Hz (10 kHz). Then, the image density unevenness, the shortage of image density, and the occurrence of leakage were visually evaluated. The results are shown in Table 1.

Comparative Example 1

In Comparative Example 1, image formation was performed in the same manner as Example 1 except that, among the developing conditions, the amplitude (Vpp) of the AC bias applied to the toner carrier was changed to 300 V, and then the image density unevenness, the shortage of image density, and the occurrence of leakage were visually evaluated. The results are shown in Table 1.

Comparative Example 2

In Comparative Example 2, image formation was performed in the same manner as Example 1 except that, among the developing conditions, the amplitude (Vpp) of the AC bias applied to the toner carrier was changed to 650 V and the frequency (f) of the AC bias applied to the toner carrier was changed to $4\times10^{3}$ Hz (4 kHz), and then the image density unevenness, the shortage of image density, and the occurrence of leakage were visually evaluated. The results are shown in Table 1.

Comparative Example 3

In Comparative Example 3, image formation was performed in the same manner as Example 1 except that, among the developing conditions, the frequency (f) of the AC bias applied to the toner carrier was changed to $3\times10^{3}$ Hz (3 kHz), and then the image density unevenness, the shortage of image density, and the occurrence of leakage were visually evaluated. The results are shown in Table 1.

Comparative Example 4

In Comparative Example 4, image formation was performed in the same manner as Example 1 except that, among the developing conditions, the amplitude (Vpp) of the AC bias applied to the toner carrier was changed to 650 V and the frequency (f) of the AC bias applied to the toner carrier was changed to $3\times10^{3}$ Hz (3 kHz), and then the image density unevenness, the shortage of image density, and the occurrence of leakage were visually evaluated. The results are shown in Table 1.

Comparative Example 5

In Comparative Example 5, image formation was performed in the same manner as Example 1 except that, among the developing conditions, the frequency (f) of the AC bias applied to the toner carrier was changed to $2.5\times10^{3}$ Hz (2.5 kHz), and then the image density unevenness, the shortage of image density, and the occurrence of leakage were visually evaluated. The results are shown in Table 1.

Comparative Example 6

In Comparative Example 6, image formation was performed in the same manner as Example 1 except that, among the developing conditions, the amplitude (Vpp) of the AC bias applied to the toner carrier was changed to 650 V and the frequency (f) of the AC bias applied to the toner carrier was changed to $2.5\times10^{3}$ Hz (2.5 kHz), and then the image density unevenness, the shortage of image density, and the occurrence of leakage were visually evaluated. The results are shown in Table 1.

Comparative Example 7

In Comparative Example 7, image formation was performed in the same manner as Example 1 except that, among the developing conditions, the amplitude (Vpp) of the AC bias applied to the toner carrier was changed to 800 V, the ratio (θ) of the peripheral speed of the toner carrier to the peripheral speed of the amorphous silicon photoconductor was changed to 1.05, and the frequency (f) of the AC bias applied to the toner carrier was changed to $2.1\times10^{3}$ Hz (2.1 kHz). Then, the image density unevenness, the shortage of image density, and the occurrence of leakage were visually evaluated. The results are shown in Table 1.

TABLE 1

| | Vpp (V) | Ds (m) | q/m × (Vpp/Ds$^2$) (1/sec$^2$) | θ (–) | f (Hz) | (f × 1.5/θ)$^2$ (1/sec$^2$) | −1.576 × 10$^{-2}$ × q/m × (Vpp/Ds$^2$) + 31.9 × 10$^6$ (1/sec$^2$) | Evaluation: Image density unevenness | Evaluation: Leakage | Evaluation: Defective image density |
|---|---|---|---|---|---|---|---|---|---|---|
| Example1 | 1000 | 1.00 × 10$^{-4}$ | 1450 × 10$^6$ | 1.50 | 5.0 × 10$^3$ | 25.00 × 10$^6$ | 9.05 × 10$^6$ | Good | Good | Good |
| Example2 | 1000 | 0.75 × 10$^{-4}$ | 2580 × 10$^6$ | 1.50 | 5.0 × 10$^3$ | 25.00 × 10$^6$ | −8.76 × 10$^6$ | Good | Good | Good |
| Example3 | 1000 | 0.50 × 10$^{-4}$ | 5800 × 10$^6$ | 1.50 | 5.0 × 10$^3$ | 25.00 × 10$^6$ | −59.51 × 10$^6$ | Good | Good | Good |
| Example4 | 800 | 1.00 × 10$^{-4}$ | 1160 × 10$^6$ | 1.50 | 4.0 × 10$^3$ | 16.00 × 10$^6$ | 13.62 × 10$^6$ | Good | Good | Good |
| Example5 | 850 | 0.75 × 10$^{-4}$ | 2190 × 10$^6$ | 1.50 | 4.0 × 10$^3$ | 16.00 × 10$^6$ | −2.63 × 10$^6$ | Good | Good | Good |
| Example6 | 1000 | 0.75 × 10$^{-4}$ | 2578 × 10$^6$ | 1.50 | 3.0 × 10$^3$ | 9.00 × 10$^6$ | −8.73 × 10$^6$ | Good | Good | Good |
| Example7 | 800 | 0.50 × 10$^{-4}$ | 4640 × 10$^6$ | 1.50 | 3.0 × 10$^3$ | 9.00 × 10$^6$ | −41.23 × 10$^6$ | Good | Good | Good |
| Example8 | 1000 | 0.50 × 10$^{-4}$ | 5800 × 10$^6$ | 1.50 | 2.5 × 10$^3$ | 6.25 × 10$^6$ | −59.51 × 10$^6$ | Good | Good | Good |
| Example9 | 800 | 0.50 × 10$^{-4}$ | 4640 × 10$^6$ | 1.50 | 2.5 × 10$^3$ | 6.25 × 10$^6$ | −41.23 × 10$^6$ | Good | Good | Good |
| Example10 | 650 | 0.50 × 10$^{-4}$ | 3770 × 10$^6$ | 1.50 | 2.5 × 10$^3$ | 6.25 × 10$^6$ | −27.52 × 10$^6$ | Good | Good | Good |
| Example11 | 650 | 1.00 × 10$^{-4}$ | 943 × 10$^6$ | 1.05 | 3.5 × 10$^3$ | 25.00 × 10$^6$ | 17.05 × 10$^6$ | Good | Good | Good |
| Example12 | 650 | 0.50 × 10$^{-4}$ | 3770 × 10$^6$ | 1.05 | 3.5 × 10$^3$ | 25.00 × 10$^6$ | −27.52 × 10$^6$ | Good | Good | Good |
| Example13 | 1000 | 0.75 × 10$^{-4}$ | 2578 × 10$^6$ | 1.05 | 2.8 × 10$^3$ | 16.00 × 10$^6$ | −8.73 × 10$^6$ | Good | Good | Good |
| Example14 | 900 | 0.50 × 10$^{-4}$ | 5220 × 10$^6$ | 1.05 | 2.1 × 10$^3$ | 9.00 × 10$^6$ | −50.37 × 10$^6$ | Good | Good | Good |
| Example15 | 1250 | 0.50 × 10$^{-4}$ | 7250 × 10$^6$ | 1.05 | 5.0 × 10$^3$ | 51.02 × 10$^6$ | −82.36 × 10$^6$ | Good | Fair | Good |
| Example16 | 1250 | 0.50 × 10$^{-4}$ | 7250 × 10$^6$ | 1.50 | 5.0 × 10$^3$ | 25.00 × 10$^6$ | −82.36 × 10$^6$ | Good | Fair | Good |
| Example17 | 1200 | 0.50 × 10$^{-4}$ | 6960 × 10$^6$ | 1.05 | 5.0 × 10$^3$ | 51.02 × 10$^6$ | −77.79 × 10$^6$ | Good | Good | Good |
| Example18 | 1200 | 0.50 × 10$^{-4}$ | 6960 × 10$^6$ | 1.50 | 5.0 × 10$^3$ | 25.00 × 10$^6$ | −77.79 × 10$^6$ | Good | Good | Good |
| Example19 | 900 | 0.50 × 10$^{-4}$ | 5220 × 10$^6$ | 1.50 | 7.5 × 10$^3$ | 56.25 × 10$^6$ | −50.37 × 10$^6$ | Good | Good | Good |
| Example20 | 900 | 0.75 × 10$^{-4}$ | 2320 × 10$^6$ | 1.50 | 7.5 × 10$^3$ | 56.25 × 10$^6$ | −4.66 × 10$^6$ | Good | Good | Good |
| Example21 | 900 | 0.75 × 10$^{-4}$ | 2320 × 10$^6$ | 1.50 | 10.0 × 10$^3$ | 100.00 × 10$^6$ | −4.66 × 10$^6$ | Good | Good | Fair |
| Example22 | 900 | 0.50 × 10$^{-4}$ | 5220 × 10$^6$ | 1.50 | 10.0 × 10$^3$ | 100.00 × 10$^6$ | −50.37 × 10$^6$ | Good | Good | Fair |
| Comparative Example1 | 300 | 1.00 × 10$^{-4}$ | 435 × 10$^6$ | 1.50 | 5.0 × 10$^3$ | 25.00 × 10$^6$ | 25.04 × 10$^6$ | Bad | Good | Good |
| Comparative Example2 | 650 | 1.00 × 10$^{-4}$ | 943 × 10$^6$ | 1.50 | 4.0 × 10$^3$ | 16.00 × 10$^6$ | 17.05 × 10$^6$ | Bad | Good | Good |
| Comparative Example3 | 1000 | 1.00 × 10$^{-4}$ | 1450 × 10$^6$ | 1.50 | 3.0 × 10$^3$ | 9.00 × 10$^6$ | 9.05 × 10$^6$ | Bad | Good | Good |
| Comparative Example4 | 650 | 1.00 × 10$^{-4}$ | 943 × 10$^6$ | 1.50 | 3.0 × 10$^3$ | 9.00 × 10$^6$ | 17.05 × 10$^6$ | Bad | Good | Good |
| Comparative Example5 | 1000 | 1.00 × 10$^{-4}$ | 1450 × 10$^6$ | 1.50 | 2.5 × 10$^3$ | 6.25 × 10$^6$ | 9.05 × 10$^6$ | Bad | Good | Good |
| Comparative Example6 | 650 | 1.00 × 10$^{-4}$ | 943 × 10$^6$ | 1.50 | 2.5 × 10$^3$ | 6.25 × 10$^6$ | 17.05 × 10$^6$ | Bad | Good | Good |
| Comparative Example7 | 800 | 1.00 × 10$^{-4}$ | 1160 × 10$^6$ | 1.05 | 2.1 × 10$^3$ | 9.00 × 10$^6$ | 13.62 × 10$^6$ | Bad | Good | Good |

The developing device of the present invention, the image forming apparatus including the device, and the image forming method using the device have made possible to adjust conditions of toner adhesion to an amorphous silicon photoconductor within preferable ranges through adjustment of the frequency and amplitude of a potential applied to a toner carrier, the distance and the peripheral speed ratio between the amorphous silicon photoconductor and the toner carrier, and the charge quantity per unit mass of toner so as to satisfy a predetermined relational expression.

Thus, it has become possible to effectively suppress the occurrence of image density unevenness by adjusting conditions of toner adhesion to an amorphous silicon photoconductor even when using both an amorphous silicon photoconductor and a nonmagnetic monocomponent toner and practicing development in a non-contact system.

Therefore, the developing device of the present invention, the image forming apparatus including the device, and the image forming method using the device are expected to contribute to the image quality improvement, the cost saving, and the like of color image forming apparatuses.

What is claimed is:

1. A developing device for visualizing an electrostatic latent image comprising: a toner carrier for a nonmagnetic monocomponent toner having a charge quantity per unit mass of q/m (C/kg); means for applying to the toner carrier an AC bias having a frequency f (Hz) and an amplitude Vpp (V), and an amorphous silicon photoconductor on which the electrostatic latent image has been formed, wherein the frequency f of the AC bias applied to the toner carrier is adjusted to a value within a range of from $2\times10^3$ to $10\times10^3$ Hz, the amplitude Vpp(V) is adjusted to a value within the range of from 500 to 1500 V, the charge quantity q/m (C/kg) per unit mass of the nonmagnetic monocomponent toner is adjusted to a value within the range of from $0.5\times10^{-2}$ to $3\times10^{-2}$ C/kg, the amorphous silicon photoconductor is disposed so that a distance Ds (m) between the amorphous silicon photoconductor and the toner carrier is adjusted to a value within a range of from $0.5\times10^{-4}$ to $1\times10^{-4}$ m, a ratio θ (–) of a peripheral speed of the toner carrier to a peripheral speed of the amorphous silicon photoconductor is adjusted to a value within the range of from 0.5 to 2, and wherein the frequency f, the ratio θ, the charge quantity q/m, the amplitude Vpp and the distance Ds are adjusted so that the following relational expression (1) is satisfied:

$$(f\times1.5/\theta)^2>-1.576\times10^{-2}\times q/m\times(Vpp/Ds^2)+31.9\times10^6 \quad (1).$$

2. The developing device according to claim 1, wherein the peripheral speed of the toner carrier is adjusted to a value within the range of from 90 to 300 mm/sec.

3. The developing device according to claim 1, wherein the peripheral speed of the amorphous silicon photoconductor is adjusted to a value within the range of from 80 to 200 mm/sec.

4. The developing device according to claim 1, wherein the ten-point average roughness of the surface of the toner carrier is adjusted to a value within the range of from 3.5 to 5.0 μm.

* * * * *